US007918627B2

(12) United States Patent
Joly

(10) Patent No.: US 7,918,627 B2
(45) Date of Patent: Apr. 5, 2011

(54) METHOD OF TREATING SOIL, IN PARTICULAR DRY SOIL SENSITIVE TO WATER

(75) Inventor: Claude Joly, Biozat (FR)

(73) Assignee: S.A. Lhoist Recherche et Developpement (BE)

( * ) Notice: Subject to any disclaimer, the term of this patent is extended or adjusted under 35 U.S.C. 154(b) by 665 days.

(21) Appl. No.: 11/883,521

(22) PCT Filed: Feb. 20, 2006

(86) PCT No.: PCT/EP2006/060106

§ 371 (c)(1),
(2), (4) Date: Aug. 1, 2007

(87) PCT Pub. No.: WO2006/089878

PCT Pub. Date: Aug. 31, 2006

(65) Prior Publication Data

US 2008/0159812 A1 Jul. 3, 2008

(30) Foreign Application Priority Data

Feb. 22, 2005 (FR) ..... 05 01769

(51) Int. Cl.
*A01C 23/00* (2006.01)

(52) U.S. Cl. ..... 405/263; 405/269; 111/123

(58) Field of Classification Search ..... 405/258.1, 405/263, 270, 271; 111/118, 123, 129
See application file for complete search history.

(56) References Cited

U.S. PATENT DOCUMENTS

| | | | | |
|---|---|---|---|---|
| 2,193,065 | A | 3/1940 | Erickson | 97/55 |
| 3,967,564 | A * | 7/1976 | Emling | 111/123 |
| 4,303,129 | A * | 12/1981 | Mills | 172/530 |
| 4,337,712 | A | 7/1982 | Michalko | 111/7 |
| 4,765,261 | A * | 8/1988 | Kaneko | 111/123 |
| 5,558,471 | A * | 9/1996 | Payne | 405/269 |
| 2004/0091319 | A1 * | 5/2004 | Schenk | 405/1 |

FOREIGN PATENT DOCUMENTS

| | | |
|---|---|---|
| DE | 3405770 | 8/1984 |
| DE | 94 21 169 | 6/1995 |
| FR | 2 471 444 | 6/1981 |
| FR | 2 593531 | 7/1987 |
| GB | 2 180 431 | 4/1987 |
| GB | 2180431 A | 4/1987 |

* cited by examiner

*Primary Examiner* — Tara Mayo-Pinnock
(74) *Attorney, Agent, or Firm* — Charles D. Gunter, Jr.

(57) ABSTRACT

A method for treating soils, in particular water-sensitive dry soils, comprising burying a treatment liquid, optionally loaded with a suspended material into trenches and a device for implementing the method. The device comprises a transportable chassis (2), a reservoir and hollow dispensing tines (1). The dispensing tines comprise a vertical supporting portion (3) which connects the dispensing tines (1) to the chassis and a horizontal share portion (4), including a spike (5) prior to penetrating into the soil, and a rear dispenser (6).

14 Claims, 1 Drawing Sheet

METHOD OF TREATING SOIL, IN PARTICULAR DRY SOIL SENSITIVE TO WATER

1. FIELD OF THE INVENTION

The present invention relates to a method of treating soil, in particular dry soil sensitive to water. The invention also relates to the device for implementing the method.

2. BACKGROUND OF THE INVENTION

In general terms, soil exhibiting a hydric deficit with respect to the optimum water content must, in order to be able to be used in the construction of civil engineering works, in the embankment, the platform, the capping layer, the subbases or the pavement layers, be treated by a soil treatment method for improving and/or stabilising it.

Many natural soils contain clays in highly variable proportions. Clays represent a family of minerals that become unstable in the presence of water; the soil then goes from the solid state to the plastic state. Clays are thus responsible for instability in constructed structures.

"Soil treatment" means, within the meaning of the present invention, a method consisting of modifying the soil so that it fulfils the function for which it is intended, in particular improvement and stabilization of the soil. A soil treatment therefore does not include for example the insertion in the soil of an impermeable layer, since such an operation does not modify the soil per se.

"Improvement" of soils means the insensitization of the soils to water by flocculation of the clays, which allows travel, short term or even immediate, of site machinery and a modification in the long term, making the treated soils insensitive to water.

"Insensitivity" to water means that the soil no longer changes towards the plastic state, during the subsequent addition of water, either by natural capillarity or through rain or flood; the change of the soil to the plastic (ticky) state and a reduction of the bearing capacity of the soil, which causes the destruction of the structure, is thus avoided. The improvements concern particularly the embankment and the preparation of soil with a view to its stabilization.

"Stabilization" of the soils means increasing the mechanical performance for re-use in the upper layers of the structure; platform, capping layer, subbase and pavement layers. Stabilization can be obtained on materials that have undergone the improvement phase by the addition or hydraulic of pozzolanic binders or by increasing the proportion of lime, which causes a pozzolanic reaction with the compounds present in the soils or a syntaxic effect in the chalky soils.

The term "lime" represents a set of compounds which are quicklime, principally composed of calcium oxide, slaked or hydrated lime, principally composed of calcium hydroxide, or an aqueous suspension produced on the basis of quick lime or hydrated lime, for example milk of lime.

In order to stabilize and improve dry soils, the methods known at the present time are treatments that are conventionally carried out with quicklime or, in the cases of fine dry soils such as clayey silt, the treatment can be carried out with milk of lime.

For a dry soil treated with lime, the dry soil treatment method requires the following steps:

1. preparation of the soil, which consists of a breaking up and loosening of the compact soil;
2. pre-moistening of the soil, generally by spraying; this pre-moistening having two objectives:

a) compensating for the hydric deficit of the soil in order to bring it to its optimum density;
b) adding the water necessary for the slaking of the lime and/or the development of the pozzolanic reactions;

3. mixing of the soil in order to distribute the added water; in many cases this operation is performed on the day before the lime treatment;
4. spreading the lime on the pre-moistened soil;
5. mixing the soil with the lime;
6. spreading water in order to adjust the content to the optimum for the type of soil treated;
7. final mixing.

When fine soils are involved, sensitive to water, for example clayey silts, the treatment can be carried out with milk of lime. This type of treatment is for example very widespread in the United States. The treatment then comprises the following steps:

1. preparation of the soil, which consists of a loosening of the compact soil;
2. pre-moistening of the soil, by spraying, in order to partly compensate for the hydric deficit;
3. mixing the soil, in order to distribute the added water;
4. spreading the milk of lime on the pre-moistened soil;
5. mixing the soil treated with milk of lime;
6. spreading any water, in order to adjust the content to the optimum for the type of soil treated;
7. final mixing.

Unfortunately these two treatment methods, respectively with lime or milk of lime, present many drawbacks, including a high number of travels of various items of machinery, which increases costs and the performance time and causes a high consumption of energy.

On sites where the soils are treated with quicklime, the quality of the mixing obtained is also disadvantaged by an overdosing of water during the pre-moistening. This overdosing causes the soil to go into a plastic state, which interferes with the travelling of earthworks machinery and causes the formation of lumps of lime, which are not distributed in the treated soil, when the soil is mixed. Moreover, the spreading of powdery lime may give rise to dust, in the event of excessively high wind, and require the work to be stopped.

The addition of water by spreading on the soil also causes trickling on sloping soils and in impressions left by the passage of the wheels of the spreading machinery, causing irregularity in the water content of the soil.

The spreading of milk of lime also leads to an overdosing of water during the pre-moistening in the points where there is an accumulation—in the machinery wheel ruts, at the bottom of slopes, etc. This phenomenon reduces the bearing capacity of the soil and interferes with the subsequent passage of site machinery. In addition, when the milk of lime is spread, the trickling on sloping soil or in machinery ruts also results in an irregularity in the lime contents in the soils treated.

In addition, the spreading is traditionally controlled by marking a surface over which the content of a tanker is to be spread. The difficulty in adjusting the flow rate to the speed of progress of the tanker frequently results in not achieving the target (overdosing) or achieving it before the tanker is empty (under dosing). This poor control of the flow spread for a given surface causes an uneven addition of lime and water on the soil.

There also exist, in the field of agriculture, water plowers provided with distributing teeth or plowing blades, also distributing, and which allow a plowing of loaded liquids such as liquid manures, in the furrows formed in agricultural soils. This equipment, for its part, has limits in use in several domains. In particular, they cannot be used on stony soils;

when there are large blocks present (>150 to 200 mm), which create a resistance to the penetration of the teeth. A mechanism incorporated in the spreader then makes the teeth emerge from the soils and the liquid is situated on the surface with all of the problems related to trickling. Moreover, their plowing depth is limited to approximately 15 cm, and the addition of liquid is limited to 25 to 30 $dm^3/m^2$.

Finally, the transverse distribution of liquid is not regular over the entire width of the passage of the machines. Liquid is situated essentially in the direct vicinity of the teeth or blades. This unevenness will not be corrected during the following steps of the soil treatment, even during mixing. This is because the mixers work the soil in the direction of travel of the equipment rather than transversely.

As equipment of this type the one described in the British Patent Application GB-A-2180431 can be cited. In this document the soil treatment method comprises

- digging in the soil, to a given depth, several parallel trenches simultaneously, and
- distribution of a treatment liquid in the said trenches, possibly containing a matter in suspension.

This equipment has the same drawbacks indicated previously.

SUMMARY OF THE INVENTION

The aim of the invention is to palliate the drawbacks of the prior art by procuring a method and device for treating soils, in particular water-sensitive dry soils, which allow suitable even plowing of treatment liquid in the soil, in particular with a view to its improvement and/or stabilization.

To resolve this problem, a soil treatment method is provided according to the invention, in particular for water-sensitive dry soils of the type indicated above, in which each of the said trenches comprises a vertical furrow having a first width ($L_1$) and, at the said given depth, a horizontal furrow having a second width ($L_2$) greater than the first, the horizontal furrows in adjoining trenches being at least laterally adjacent, the said distribution of treatment liquid takes place in all the horizontal furrows in the trenches over their entire width, by depositing in these a continuous stream of treatment liquid, and the method also comprises a subsidence of the soil that covers the stream of treatment liquid deposited in the horizontal furrows with uniform plowing of it in the soil to be treated.

The terms "digging of a trench or digging of trenches" means a formation of one or more temporary trenches, which implies a loosening of the surrounding soil and results in the temporary trench breaking down or sinking rapidly once the treatment liquid is deposited, this sinking allows the uniform plowing in of liquid and is practically simultaneous with the digging.

The words "horizontal furrow having a second width L2", means a tunnel whose width is $L_2$. According to the invention, a continuous stream of treatment liquid is deposited in the horizontal furrow, and therefore in the aforementioned tunnel.

Then the method comprises a sinking of the soil that covers the stream of treatment liquid deposited in the tunnel and the latter almost immediately sinks through its top part, the treatment liquid being plowed in a uniform manner into the soil to be treated. The method according to the invention thus allows an even lateral dispersion of the treatment liquid since the trenches into which the treatment liquid is introduced are dug so that the horizontal furrows are laterally adjacent or even possible overlap one another and there is no longer any dead space untreated or differently treated between two adjoining trenches.

The method according to the invention therefore uses a plowing system which makes it possible to introduce the treatment liquid at a predetermined depth with a regular distribution in width, which facilitates the appropriate apportioning of the treatment liquid and makes it possible to limit the number of passages of machinery, which considerably reduces costs.

Consequently, by plowing in the treatment liquid, which may be water, a milk of lime or any other aqueous suspension based on lime, the risks of overdosing of water or any matter in suspension are eliminated. This is because the plowing in of a treatment liquid according to the invention can replace the steps of prior moistening, mixing and spreading of the milk of lime, eliminates the problem of trickling of water on sloping soils and in the impressions of machinery and, in this way, regularizes the water content of the soil.

Advantageously, the predetermined depth of plowing according to the invention is a depth of 20 to 75 cm, preferably 35 to 60 cm.

In the field of improvement and stabilization of dry soils, these successive layers of the embankment can reach, for example, 50 cm in height and a plowing depth possibly greater than 50 cm may be necessary. Consequently the method according to the invention provides for a plowing in of a depth ranging from 20 to 75 cm, preferably 35 to 60 cm.

Advantageously, in a preferential embodiment of the invention, the treatment liquid has a solid content ranging up to 1000 $g/dm^3$, preferably approximately 400 $g/dm^3$. As a treatment liquid it is possible to consider a milk of lime for example.

In other cases of soils, certain compact stony materials are found, for example pelites that require a significant breaking up before they are treated for use in embankment, platform, capping layer, or even subbase or pavement layer. In the natural state, these materials are in the form of compact slabs. An addition of water enables these stones to be partly split up. However, after breaking up, there remain blocks that have a size ranging up to 600 mm. This large size makes the existing water addition means unsuitable. Moreover, finer crushing, necessary in order to comply with specifications that have a requirement of not exceeding 200 mm for capping layer, is prohibited because of the abrasive character of the stones, which causes rapid wear to the equipment.

For this reason, these stones must, according to the prior art, be removed, which requires loading, transport and expensive storage. Moreover, the stony material must be replaced by a fine substitute material, which complicates the treatment of the soil and increase the costs thereof further, because of the many movements of material and the energy necessary for the granulometric reduction of the stones.

In order to resolve this problem, the method according to the invention, in the case of such soils, also comprises:

- a prior digging in the soil to be treated, to a predetermined depth, simultaneously several prior trenches comprising a prior vertical furrow having a first width and, at the said predetermined depth, a prior horizontal furrow having a second width greater than the first, the prior trenches being dug parallel so that the prior horizontal furrows are at least laterally adjacent,
- a distribution of water in all the prior horizontal furrows over the entire width, by depositing in these a continuous stream of water, and a sinking of the soil that covers the stream of water deposited in the prior horizontal furrows with uniform plowing of the water into the soil to be treated.

Consequently the treatment method according to the invention also makes it possible to treat with water these stones or pelites described above, directly as from stones having a size that may attain 600 mm. The method also allows crumbling with water, and avoids their removal and replacement with a substitute material. This soil can subsequently be treated with the treatment liquid with the same plowing-in system.

The invention also relates to a device for implementing the method according to the invention. This comprises:

a conveyable chassis, at least two hollow distributing teeth, and a reservoir of treatment liquid, designed to distribute the said treatment liquid to a distribution channel housed in each of the said distributing teeth. This device is characterised in that the said distributing teeth each comprise:

a vertical support part that connects the distributing tooth to the chassis, has the said first width and comprises the said distribution channel, a horizontal plowshare part, comprising a front spike for penetrating the soil, and a rear distributor that is provided with an outlet orifice having the said second width greater than the said first width and that communicates with the said distribution channel of the said support part, the said horizontal plowshare parts of adjacent teeth being capable of forming in the soil horizontal furrows at least laterally adjacent and the said outlet orifices being designed to deposit a continuous stream of treatment liquid in the horizontal furrows.

The device according to the invention, provided with hollow distributing teeth, incorporates in depth the treatment liquid.

The type of tooth consequently has been designed to allow the plowshare part to remain at the predetermined depth, even when there are stones with a size greater than 600 mm, in particular when there are pelites, and to distribute therein, without overflow on the surface, the sufficient quantities of treatment liquid, such as for example a milk of lime, up to solid contents of 400 g/dm$^3$ or even 1000 g/dm$^3$, when these suspensions contain fluidizing agents. The device serves for flow rates as from 20 to 30 dm$^3$/m$^2$ but the flow rate can also easily achieve 90 dm$^3$/m$^2$, or even up to 300 dm$^3$/m$^2$. This result is obtained without the risk of blocking the treatment liquid supply, either by the solid of the suspension or the soil particles.

In addition, the unique design of the plowshare part makes it possible firstly to lift the large stones to the surface of the broken-up soil by virtue of its soil penetration spike of the plowshare type, this then makes it possible to split them, and secondly it allows an equivalent distribution of treatment liquid in each of the teeth starting from the reservoir by virtue of the rear distributor, which has an outlet orifice having the said second width greater than the said first width and which communicates with the said distribution channel of the said support part. This requires in particular good equilibrium of the pressures between the supplies to the various teeth, starting from the reservoir.

"Conveyable" means a chassis that can be pushed or drawn or even be self-propelling.

Advantageously, the device comprises a reinforcement element connecting the said support part and the plowshare part, which makes it possible to withstand any impact with stones with a size greater than 600 mm, in particular with pelites, as described above.

In a particularly preferential embodiment according to the invention, the chassis has a chassis width and the outlet orifices of the said distributing teeth connected to the said chassis are, in a rear view, directly adjacent to one another, the said outlet orifices preferably occupying a width at least equivalent to the said chassis width.

Consequently the teeth are aligned so that the width covered by each tooth is complementary to the others and thus covers, without any dead zone, the entire width of the chassis. Any transverse variation in treatment liquid plowed in, encountered during treatment with conventional equipment that is traditionally not rectified by a transverse pass, is thus avoided.

Advantageously, according to the invention, provision is made for, in a plan view, the distributing teeth connected to the said chassis to be placed in a staggered fashion, aligned in at least two parallel rows. This allows a homogeneous distribution of the treatment liquid. It is clear that the outlet orifices of the teeth cannot be perfectly adjacent given the thickness of their wall and that consequently placing the teeth in a staggered fashion allows the digging of perfectly adjacent furrows. When pelites are present and they encounter a distributing tooth, the stone is diverted laterally and does not encounter another tooth since the teeth are placed in a staggered fashion. In addition, the teeth aligned in two rows remain much better pressed into the ground as the conveyable chassis moves forward. This arrangement reduces any lifting of the chassis as the device according to the invention progresses in a soil to be treated. For this same reason of balancing the resistance during forward movement, the teeth will advantageously be five in number.

In a particularly preferential embodiment of the invention, the teeth have a length making it possible to plow in the treatment liquid to a depth of 20 to 75 cm preferable 35 to 60 cm.

Consequently the plowing in to the predetermined depth according to the invention and the shape of the furrows dug do not pose any problem in the event of encountering stones with a size less than approximately 600 mm. The stones pass between the vertical furrows and, since the teeth do not rise up, the adjacent horizontal furrows remain adjacent and the spreading remains uniform. The plowing in of the treatment liquid according to the invention is not diverted from its path by blocks. The type of furrow makes it possible to remain at the required depth and to distribute therein, without any overflow on the surface, sufficient quantities of treatment liquid.

Advantageously, each distribution channel is provided with a flow regulator element. The flow regulator element can be a diaphragm capable of adjusting the cross section of flow of liquid in the distribution channel. In this way an even distribution of the flow rate is obtained throughout all of the distribution channels.

Other embodiments of the method and device for implementing the method according to the invention are indicated in the accompanying claims.

BRIEF DESCRIPTION OF THE DRAWINGS

Other characteristics, details and advantages of the invention will emerge from the description given below, non-limiting and with reference to the accompanying drawings.

In the figures, the identical or similar elements bear the same references.

DETAILED DESCRIPTION OF THE INVENTION

Figure 1:
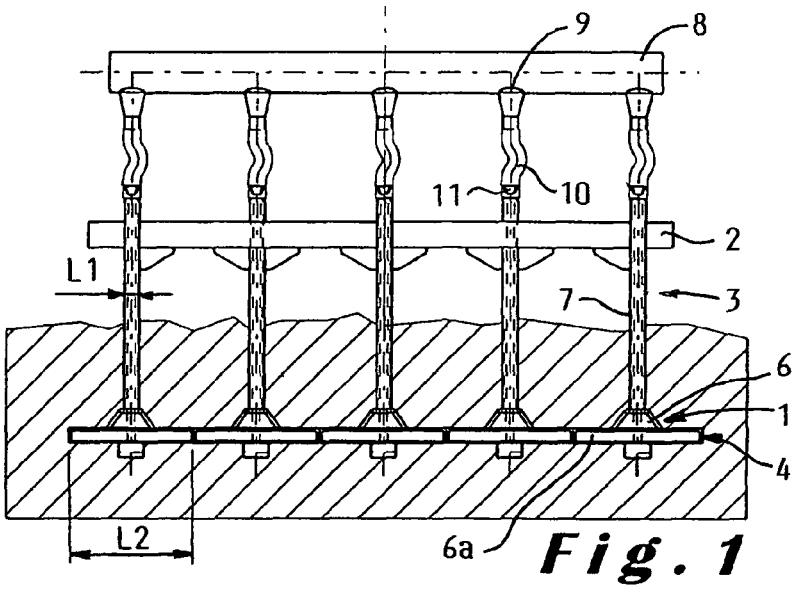
FIG. 1 is a rear view of a preferential embodiment of the device according to the invention in which the chassis comprises five hollow distributing teeth sunk in the soil.

As can be seen in FIG. 1, teeth 1 are fixed to the chassis 2. Each tooth comprises a vertical support part 3 and a horizontal plowshare part 4. The plowshare part 4 comprises a front spike 5 (FIG. 3) for penetration in the soil and a rear distributor 6 that has an outlet orifice 6*a*. As aforementioned, the support part 3 of each tooth 1 comprises a distribution channel 7 and has a width $L_1$ that is less the width $L_2$ of the outlet orifices of the plowshare part of the said tooth. The width $L_2$ is such that, in a rear view (FIG. 1), the treatment liquid outlet orifices 6*a* of the distributors 6 are directly adjacent to one another. Consequently, over the width of the chassis the outlet orifices 6*a* of the distributors 6 are joined together to allow the deposition of a continuous stream of treatment liquid.

The support part 3 of each tooth 1 therefore comprises a distribution channel 7 that communicates with a treatment liquid reservoir (not illustrated) by means of a distribution tank 8 that enables the dosing of the treatment liquid to be identical in each tooth 1.

The distribution tank 8 is equipped, in the preferential embodiment illustrated, with five outlets 9 connected to a flexible hose 10 that supplies the distribution channel 7 of each support part 3 of each hollow distributing tooth 1.

The treatment liquid coming form the reservoir arrives in the tank 8, which distributes it between the distribution channels 7 of each tooth 1, it flows and enters the horizontal plowshare part 4 of each tooth 1, or more precisely the distributor 6, and is then brought to the outlet orifice 6*a* thereof. It is only after the outlet orifice 6*a* passes through the horizontal furrow dug at the front by the plow share part 4 of the tooth 1 that the natural terrain sinks by virtue of the breaking-up of the surrounding earth and that it comes to cover the treatment liquid stream deposited. The sequence of digging the trench, deposition of the liquid in the adjacent horizontal furrows and of sinking of the soil takes place in this order as the equipment moves forward. Nevertheless, because of the speed of advance, it can be said that these three phases are almost simultaneous.

When the flow of treatment liquid, for example milk of lime, is less than 100 $dm^3/m^2$, a reduction in the cross section of flow of the distribution channel by a diaphragm 11 can be interposed at the entry to the distribution channel 7 in order to balance the flow rate on each tooth 1. Exchangeable diaphragms can be provided or diaphragms with remote-controlled adjustable cross sections.

The height of the support part can be as much as 75 cm, preferably 60 cm, and the height of the chassis with respect to the ground allows the passage of blocks of 600 mm (60 cm). Blocks of 600 mm can consequently also pass between the teeth.

Figure 2:
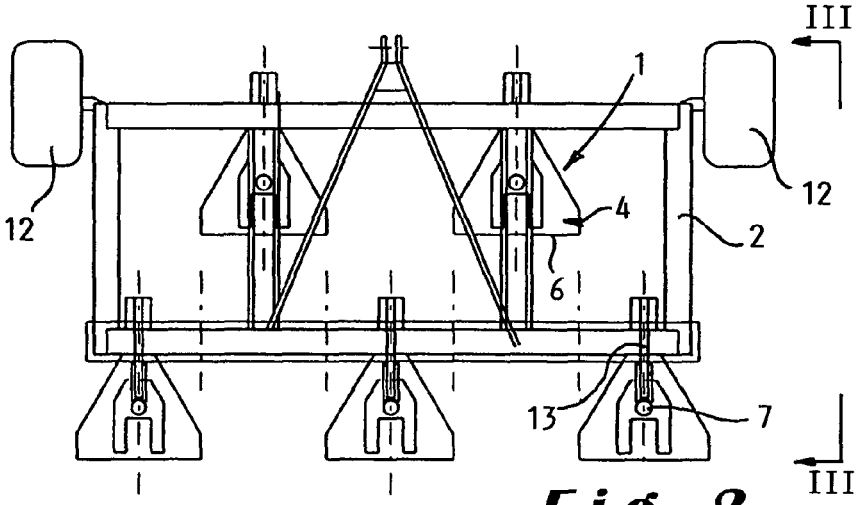
FIG. 2 is a view in elevation of the embodiment illustrated in FIG. 1.

As can be seen in FIG. 2, the chassis 2 of the preferential embodiment illustrated comprises five hollow distributing teeth 1 aligned in two rows in a staggered fashion. In this embodiment, the chassis is supported by wheels 12.

The front row comprises two teeth 1 and the rear row comprises three of them. This arrangement allows better distribution of the traction force on the chassis and makes it possible to keep the teeth 1 continuously in the soil. If necessary it is possible to add a lateral counterweight device simply attached to the chassis in order to keep it pressed and to keep the teeth well sunk in the soil.

Figure 3:
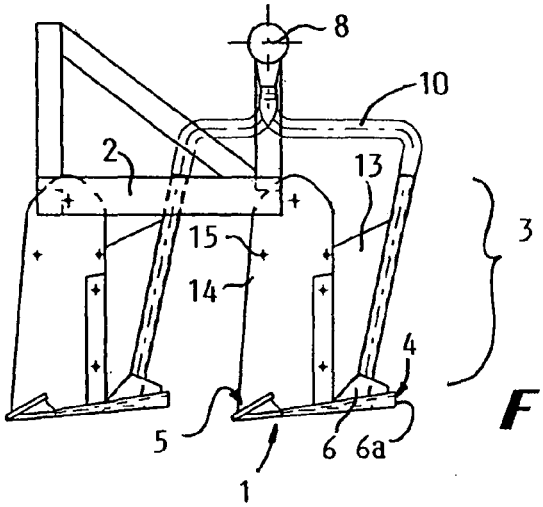
FIG. 3 is a profile view of the embodiment illustrated in FIG. 1.

In FIG. 3, the profile of the hollow distributing teeth 1 according to the invention can be seen in more detail. The support part 3 comprises a support plate 14 and a reinforcement piece 13 attached by suitable fixing means 15, such as for example, bolts, screws, nuts and the like. These fixing means are situated on the support plate 14. This reinforcement piece 13, the rigidity of the chassis 2 and the means of fixing the teeth to the latter make it possible to keep the teeth in the soil continuously and reinforces the device according to the invention for the purpose of conferring on it sufficient resistance against the forces due to stones and pelites that it may possibly encounter. As already stated above, the plowshare part 4 is equipped with a welded spike 5 at the front that ensures penetration in the soil. This soil penetration spike 5 can be replaced in the event of wear.

The invention will now be described in more detail by means of non-limiting examples which are inserted here solely for illustrative purposes.

Comparative Example 1

A highway site passing over flint-bearing clays, dry, compact and sensitive to water, requires the plowing in of milk of lime at 400 $g/dm^3$ in order to add 30 g of water and 20 g of quicklime per kg of soil, ie 12 kg of lime to the $m^2$ and 22 $dm^3$ to the $m^2$.

The following conventional soil treatment procedure was adopted.

1. Breaking up and loosening the soil by three successive passes of a breaking up device at a depth of 40 cm, providing a ground-up soil up 500 to 600 mm.
2. Reducing the ground-up soil on the surface by crushing, to less than 150 to 200 mm over a depth of 15 to 20 cm.
3. Plowing in the milk of lime by agricultural tanker, equipped with a conventional plow with combined disc and cross bracing, at 25 $dm^3/m^2$, ie 17 g of lime and 25 g of water per kg of soil.
4. Mixing to a depth of 40 cm with a ground soil at less than 30 mm in one pass.

At the end of the treatment, soil samples were taken in order to evaluate the quality of treatment in the laboratory.

This treatment method by traditional plowing equipment required step 2 of supplementary reduction of the ground soil at less than 200 mm in order to avoid losses of milk of lime, as a consequence of the frequent raising of the teeth of the plow.

In addition, laboratory tests show that the water content in the ground is very uneven and sometimes at the alert threshold, which is 95% of the water content at optimum density, or even of the refusal threshold (90% of the water content at optimum density). Indeed, the target water content is between 144 g and 177 g per kg of soil. After a pass of the traditional plow, the water content varied between 119 g and 177 g/kg of soil, showing certain deficits in places. On the other hand, a second pass of the plow results in excessively high contents, between 193 g and 219 g/kg of soil.

A single plow pass does not therefore make it possible to achieve the required water content. Some values are too low and do not make it possible to accept the platform. The work must be repeated. It would therefore be necessary to be able to increase the quantity plowed in at each pass.

Moreover, the presence is recorded of trickling on the surface in line with the plowing-in furrows. The penetration depth is too low; it would be necessary to increase it to eliminate the trickling.

Finally, it is noted that the dispersion of the water content values is too great, up to more then 30% of the target value:

around 60 g of difference per kg of soil (119 g/kg and 177 g/kg) between the extreme values, at a single pass. The distribution of the treatment liquid in the soil is not sufficiently regular.

Comparative Example 2

A highway site passing over volcanic materials, of the pelite type, very compact stones that sometimes are set edgewise in the presence of water, requires a plowing in of 50 $dm^3$ of water per $m^2$ before treatment with lime.

In order to build a capping layer, the following conventional procedure for treating the soil was adopted.

1. Breaking up and loosening the soil by passing a breaking up device to a depth of 40 cm, providing ground-up soil to less than 600 mm.
2. Loading, removing and storing the pelites.
3. Adding substitute material.
4. Moistening the added material by traditional plow.
5. Adding quicklime.
6. Mixing the soil.
7. Adjusting the water content.
8. Mixing the soil.

This treatment method by traditional plowing equipment required steps 2 and 3 of removing the pelites and adding a substitute material.

This is because the traditional water adding equipment does not make it possible to directly treat the granulometric fraction ranging up to 600 mm of these stones (raising the teeth etc). In addition, the number of passes of the breaking up machines (bulldozers or compactors equipped with breaking up teeth) necessary to reduce the size of the stones to less than 200 mm would be prohibitive. In addition, large stones remain buried in the materials, making the soil unsuitable for the required use, requiring a granulometry of less than 200 mm. The pelites are therefore removed and replaced with a fine substitute material, which delays the work and considerably increase cost.

Equipment would therefore be required that makes it possible to plow in the water sufficiently deeply in the soil in order to split the pelites in the mass of soil worked. This equipment would have to make it possible to work when there are blocks of a size of up to 600 mm.

Example 3 According to the Invention

A soil is treated to build the capping layer of a highway site, similar to that of comparative example 2 and comprising materials of the pelite type, very compact but splitting in the presence of water. A plowing-in of water is provided before treatment with lime.

A procedure of treating the soil according to the invention was adopted.

1. Breaking up and loosening of the soil by passing a breaking up device to a depth of 40 cm, providing ground-up soil to less than 600 mm.
2. Passing a compactor equipped with breaking up teeth.
3. Passing a plowing-in equipment according to the invention, which participates in the de-compacting of the soil and adds 20 $dm^3$ of water per $m^2$. During the same plowing-in operation, the large blocks are brought to the surface.
4. Passing a compactor equipped with teeth for breaking up or removing large blocks.
5. Plowing in milk of lime with equipment according to the invention, in order to effect a supplementary addition of 30 $dm^3$ of water per $m^2$ and an addition of lime corresponding to a dose of 1.5% with respect to the dry material of the soil.
6. Mixing the soil.

At the end of the treatment, soil samples were taken in order to evaluate the quality of the treatment in the laboratory.

This treatment method according to the invention first of all avoids steps 2 and 3 of comparative example 2 of removing pelites and adding a substitute material. The whole of steps 2 to 4 of comparative example 2 are replaced by direct moistening of the coarse stones by means of the equipment according to the invention, framed by two compacting operations. The method according to the invention therefore proves more simple, more rapid and less expensive for steps 2 to 4 of the method.

Moreover, in the method according to the invention, the addition of water can easily be limited to step 3, avoiding any risk of trickling while adding enough water for splitting the stones. This is because the additional water is added by reusing the plowing-in equipment according to the invention in order to add a milk of lime rather than a quicklime, as in comparative example 2. This is because the plowing-in equipment according to the invention makes it possible to inject a milk of lime at sufficient depth (35 to 55 cm) without risk of trickling, present in comparative example 1, with traditional equipment. There is no hydric correction necessary after step 6, as is the case in the traditional solution, at steps 7 and 8 of comparative example 2.

The soil treatment method according to the invention therefore makes it possible to reprocess pelites on site, which are initially in the form of compact stones, traditionally not used.

Likewise, contrary to the traditional treatment of comparative example 1, the method according to the invention makes it possible to comply scrupulously with the water content sought over the ENTIRE width of the equipment without any dead zone (untreated zone). There is therefore no significant dispersion of the values of the water contents according to the invention, as was the case with the traditional equipment of comparative example 1. This is because the water content of the soil varied by scarcely±2 g/kg of soil, for a target of 175 g/kg.

The plowing equipment according to the invention therefore fulfils several roles:

assistance with breaking up of the soil;

the addition of water in a stony soil, with consistent distribution in the soil, the plowing-in of the quantity of lime necessary for the treatment of the soil.

For an addition of water limited to 50 $dm^3/m^2$, the method according to the invention saves on one plow pass (in comparison with comparative example 1). Moreover, the method according to the invention makes it possible to avoid spreading with powdery lime (in comparison with comparative example 2; it also avoids the final hydric correction and one mixing pass. The equipment according to the invention increases the mixing performance by participating in the reduction of the size of the blocks in the soil, and prevents premature wear or rupture of the rotors by allowing removal of the blocks of large size.

Naturally the present invention is in no way limited to the embodiments described above and many modifications can be made thereto without departing from the scope of the accompanying claims.

The invention claimed is:

1. A method of treating soils, comprising:

digging in the soil, to a given depth, several parallel trenches simultaneously each comprising a vertical furrow having a first width ($L_1$) and at the said given depth a horizontal furrow forming a tunnel having a second width ($L_2$) greater than the first, the horizontal furrows of the adjoining trenches being at least laterally adjacent, so that no dead space any longer exists between two adjoining trenches, depositing in said tunnels of all the horizontal furrows of the trenches a continuous stream of a liquid soil treatment, and stabilizing the soil by a homogeneous lateral distribution of the liquid soil treatment over the entire width of the horizontal furrows of the trenches, and by sinking of the soil that covers the stream of liquid soil treatment deposited in said tunnels of the horizontal furrows as the result of uniform plowing of this liquid soil treatment into the soil to be treated.

2. The method according to claim 1, in which at the predetermined depth is a depth of 20 to 75 cm.

3. The method according to claim 1, in which the liquid soil treatment is selected from the group consisting of a milk of lime, water and an aqueous suspension based on lime.

4. The method according to claim 1, in which the liquid soil treatment has a solid content ranging up to 1000 g/dm$^3$.

5. The method according to claim 1, characterized in that the said distribution supplies a flow rate of 20 dm$^3$/m$^2$ to 300 dm$^3$/m$^2$ of liquid soil treatment.

6. The method according to claim 1, comprising, before the said digging, prior digging in the soil to be treated, to a predetermined depth, of several prior simultaneously dug trenches, the simultaneously dug trenches each comprising a prior vertical furrow having a first width ($L_1$) and, at the said predetermined depth, a prior horizontal furrow having a second width ($L_2$) greater than the first ($L_1$), the prior trenches being dug parallel so that the prior horizontal furrows are at least laterally adjacent, a distribution of water in all the prior horizontal furrows over the entire width, by depositing in these a continuous stream of water, and a sinking of the soil that covers the stream of water deposited in the prior horizontal furrows as a result of uniform plowing-in of the water in the soil to be treated.

7. A device for implementing the method according to claim 1, comprising:

a conveyable chassis (2), at least two distributing teeth (1), and a liquid soil treatment, reservoir, designed to distribute said liquid soil treatment to a distributing channel (7), said distributing teeth (1) each comprise:

a vertical support part (3) that connects the said distributing tooth (1) to the chassis (2) and, has a first width ($L_1$), said distributing tooth (1) being hollow for accommodating one of said distributing channels (7), in the vertical support part (3), and a horizontal plowshare part (4), comprising a front spike (5) for penetrating the soil, and a rear distributor (6), that is provided with an outlet orifice (6*a*) having a second width ($L_2$) greater than the said first width ($L_1$) and that communicates with the said distribution channel (7) of the said support part (3), the outlet orifices (6*a*) of said distributing teeth (1) being, in a rear view, at least laterally adjacent to one another, to thereby form in the soil horizontal furrows at least laterally adjacent without any dead space between them, the said outlet orifices being designed to deposit in the horizontal furrows a continuous stream of liquid soil treatment.

8. The device according to claim 7, in which the support part (3) comprises a reinforcement element (13) connecting the said support part (3) and the plowshare part (4).

9. The device according to claim 7, in which the chassis (2) has a chassis width and in which the outlet orifices (6*a*) of the said distributing teeth (1) connected to the said chassis (2) are, in a rear view, directly adjacent to one another.

10. The device according to claim 7, in which, in a plan view, the distributing teeth (1) connected to the said chassis (2) are placed in a staggered fashion, so as to be aligned in at least two parallel rows.

11. The device according to claim 7, in which the distributing teeth (1) have a length making it possible to plow in the liquid soil treatment to a depth of 20 to 75 cm.

12. The device according to claim 7, in which the distributing teeth (1) are 5 in number.

13. The device according to claim 7, characterized in that each distribution channel is provided with a flow rate regulating element.

14. The device according to claim 13, characterized in that the flow rate regulating element is a diaphragm capable of adjusting the cross section of flow of liquid in the distribution channel.

* * * * *